US009357834B2

(12) United States Patent
Bow et al.

(10) Patent No.: US 9,357,834 B2
(45) Date of Patent: Jun. 7, 2016

(54) COSMETIC APPLICATOR BRUSH AND METHOD OF MANUFACTURE

(75) Inventors: Clark Bow, Dandridge, TN (US); Horst Herlitze, Morristown, TN (US)

(73) Assignee: ALBÉA SERVICES, Gennevilliers (FR)

( * ) Notice: Subject to any disclaimer, the term of this patent is extended or adjusted under 35 U.S.C. 154(b) by 527 days.

(21) Appl. No.: 12/530,001

(22) PCT Filed: Apr. 7, 2008

(86) PCT No.: PCT/IB2008/001874

§ 371 (c)(1),
(2), (4) Date: Sep. 4, 2009

(87) PCT Pub. No.: WO2008/125987

PCT Pub. Date: Oct. 23, 2008

(65) Prior Publication Data

US 2010/0326457 A1 Dec. 30, 2010

Related U.S. Application Data

(60) Provisional application No. 60/923,075, filed on Apr. 12, 2007.

(51) Int. Cl.
*A46D 1/00* (2006.01)
*A46B 9/02* (2006.01)
(Continued)

(52) U.S. Cl.
CPC . *A46B 9/021* (2013.01); *A46B 3/16* (2013.01); *A46D 9/02* (2013.01); *A46B 2200/1053* (2013.01)

(58) Field of Classification Search
CPC ..... A45D 40/26; A45D 40/262; A45D 40/28; A45D 40/30; Y10T 428/23957
USPC ..... 132/218, 320, 318, 313, 317, 160; 15/160, 206, 207; 401/129; 428/92
See application file for complete search history.

(56) References Cited

U.S. PATENT DOCUMENTS 5,007,686 A * 4/1991 Klein et al. ..... 300/21
5,017,423 A * 5/1991 Bossmann ..... B29C 59/16 219/121.65

(Continued)

FOREIGN PATENT DOCUMENTS

EP 1459647 A1 9/2004
JP 200178837 A 3/2001

(Continued)

OTHER PUBLICATIONS

International Search Report and Written Opinion mailed Jun. 22, 2009 for PCT/IB2008/001874.

*Primary Examiner* — Todd E Manahan
*Assistant Examiner* — Brianne Kalach
(74) *Attorney, Agent, or Firm* — Banner & Witcoff, Ltd.

(57) ABSTRACT

A cosmetic applicator brush having a twisted wire core and an array of thermoplastic bristles with free tips extending radially outwardly from the core, wherein at least some of the bristles have shapes and/or surface textures modified at one or more localities between their free tips and the core by selective irradiation of the aforesaid locality or localities with laser energy. A method of making the brush includes the steps of assembling the core and bristles to form a brush, trimming the bristles to achieve a desired brush profile, and selectively irradiating at least some of the bristles with a laser beam at localities between the bristle tips and the core.

8 Claims, 3 Drawing Sheets

(51) Int. Cl.
*A46B 3/16* (2006.01)
*A46D 9/02* (2006.01)

(56) References Cited

U.S. PATENT DOCUMENTS 5,542,439 A * 8/1996 Gueret ..... 132/218
5,657,778 A * 8/1997 Gueret ..... A46B 3/18 132/216
6,450,177 B1 * 9/2002 Christoforu et al. ..... 132/218
2002/0005209 A1 * 1/2002 Gueret ..... A45D 40/267 132/218
2003/0213498 A1 * 11/2003 Gueret ..... 132/218
2004/0040567 A1 * 3/2004 Rousselet ..... 132/218
2004/0168698 A1 9/2004 Gueret
2004/0240926 A1 * 12/2004 Gueret ..... A46B 3/18 401/122
2004/0244809 A1 * 12/2004 Gueret ..... 132/218
2005/0160546 A1 7/2005 Weihrauch
2005/0236008 A9 * 10/2005 Gueret ..... 132/218
2005/0268415 A1 * 12/2005 Montoli et al. ..... 15/207.2
2006/0186725 A1 8/2006 Weihrauch
2007/0151062 A1 * 7/2007 Mehlhorn ..... 15/186

FOREIGN PATENT DOCUMENTS

JP 2007-224436 * 9/2007
WO 0158309 A1 8/2001

* cited by examiner

COSMETIC APPLICATOR BRUSH AND METHOD OF MANUFACTURE

CROSS-REFERENCE TO RELATED APPLICATIONS

This application is a U.S. National Stage application under 35 U.S.C. §371 of International Application No. PCT/IB2008/001874 (published as WO 2008/125987), filed Apr. 7, 2008, which claims the benefit of priority of U.S. Provisional Application No. 60/923,075 filed Apr. 12, 2007. Each of these prior applications is incorporated by reference in its entirety.

BACKGROUND OF THE INVENTION

This invention relates to brushes for applying cosmetic materials and the like, and to methods of making such brushes. In an important specific sense, to which detailed reference will be made herein for purposes of illustration, the invention is directed to twisted-in-wire mascara brushes having thermoplastic fiber bristles.

A twisted-in-wire mascara brush includes an elongated twisted wire core and a multiplicity of bristles clamped at their midpoints in the core and extending radially outwardly therefrom, with free tips cooperatively defining a notional envelope or profile of the brush. The core is constituted of two lengths of wire, which may be initially separate or may be opposed legs of a single U-shaped wire, twisted together into a helix to hold the bristles between them. This core has a proximal end, usually mounted on a stem, and a free distal end to which the array of bristles ordinarily extends; the stem itself typically is carried by and projects from the cap of a mascara container, the cap serving as a handle for manipulation of the brush by a user.

When the cap is seated on the neck of the container, the brush is inserted within the container interior so as to be immersed in the contained mascara. Upon removal of the cap from the neck, the brush is withdrawn from the container, bearing mascara on its bristles, and passes through a wiper mounted in the container neck which controls the amount of mascara carried from the container on the brush. The user, holding the container cap, then manipulates the brush to apply the mascara to, and distribute it over, the lashes. Thus, the brush performs several functions in use: transporting mascara from the container to the lashes, depositing it on the lashes, and combing and arranging the lashes.

Some twisted-in-wire mascara brushes employ straight thermoplastic (e.g. nylon) bristles of solid cylindrical shape and substantially uniform thickness with ends defining a cylindrical or conical (tapering) profile or a profile having a proximal cylindrical section and a distally tapering distal section. The manufacture of these brushes involves initially assembling the bristles and the core wire, twisting the wire to produce an array of radiating bristles gripped in an axially rectilinear core, and then trimming the outer ends of the bristles in the array to achieve the desired profile shape.

Heretofore, however, numerous modifications have been introduced or proposed, especially to enhance the performance of some one or more of the diverse functions listed above. Thus, bristles of various different cross-sections including hollow cylindrical fibers, longitudinally grooved fibers and fibers of multi-lobed cross-section have been used (see, e.g., U.S. Pat. Nos. 4,733,425 and 5,197,497), as well as fibers of irregular cross-section (see, e.g., U.S. Pat. No. 6,016,815). In addition, fibers having different physical characteristics or properties, such as relatively stiff and relatively soft fibers, have been combined in a single brush, either intermixed together throughout the length of the brush (U.S. Pat. No. 4,861,179; see also U.S. Pat. No. 4,964,429) or separately disposed in discrete tandem zones along the brush length (see, e.g., U.S. Pat. Nos. 5,482,059 and 5,709,230), stiffer fibers being preferred for combing lashes and softer fibers being advantageous for transporting and delivering mascara. Again, it has been proposed to trim the bristles into profile shapes more complex than simple cylinders or cones, so as to provide profile edges or faces that aid in combing lashes and distributing mascara therethrough (see, e.g., U.S. Pat. Nos. 4,898,193 and 5,357,987).

The use of thermal energy for selective reduction in length of bristles in a twisted-in-wire mascara brush has been described, for example, in U.S. Pat. Nos. 5,197,497 and 5,345,644, wherein the brush is constituted of bristles of larger section and bristles of smaller section differing from each other in resistance to heat or melting point so that upon exposure to heat, the bristles of lower heat resistance or melting point become shorter than those of higher heat resistance or melting point; the heat treatment also forms bulges at the ends of the bristles owing to melting of the ends. Melting of bristle tips to round them by inserting a twisted-in-wire brush in a heating chamber is described in U.S. Pat. No. 4,998,779, which notes that laser beams have been used to melt and round bristle tips of brushes in which all the bristles are oriented in the same direction, but that such processes are unsatisfactory for twisted-in-wire brushes. U.S. Pat. No. 5,941,605 describes use of a laser beam to cut the bristles of a cosmetic brush so as to produce a desired brush profile, but without melting the bristles being cut.

SUMMARY OF THE INVENTION

The present invention in a first aspect contemplates the provision of a cosmetic applicator brush comprising a core and an array of thermoplastic bristles with free tips extending radially outwardly from the core, wherein at least some of the bristles have shapes and/or surface textures modified at one or more localities between their free tips and the core by selective irradiation of the aforesaid locality or localities with laser energy. The shape or surface modifications may, for example, be such as to enhance the ability of the brush to carry and deliver cosmetic material from a container thereof to a user's face. In illustrative or preferred embodiments of the brush, e.g. for application of mascara, the core is an elongated twisted wire core and the bristles are fibers each having opposed free tips and are gripped in the core intermediate their free tips.

In a second aspect, the invention embraces a method of making a brush for applying cosmetic material or the like, comprising the steps of forming a twisted-in-wire brush including an elongated twisted wire core and a multiplicity of thermoplastic bristles clamped in the core and extending radially therefrom to constitute a brush bristle array projecting outwardly around the core, the bristles having free tips; and irradiating at least some of the bristles of the formed brush with laser energy selectively at one or more localities intermediate their free tips and the core to selectively modify the irradiated bristles at least at the aforesaid one or more localities.

As will be understood, the free tips of the bristles cooperatively define a profile of the brush; the method of the invention may further include a step of shaping this profile by trimming at least some bristles of the brush after the forming step and before the irradiating step.

The selective modification of the bristles may include modification of at least one of the shape and surface texture of the bristles at the aforesaid one or more localities. For example, the laser-irradiated bristles may be caused to bend at the locality or localities of irradiation.

The irradiating step may comprise providing a source of a focused beam of laser energy and subjecting the source and the formed brush to controlled relative motion such that the beam impinges on the aforesaid one or more localities of at least some of the bristles to effect the selective modification thereof.

In this way, for example, brushes may be provided having, e.g. at different locations, superior specific characteristics for performance of different functions incident to application of cosmetic material such as mascara.

Further features and advantages of the invention will be apparent from the detailed description hereinafter set forth, together with the accompanying drawings.

DETAILED DESCRIPTION

The cosmetic brush of the present invention, in illustrative embodiments, may be a twisted-in-wire mascara brush in which at least some of the bristles are modified, in shape and/or surface texture, with radiant energy delivered by application of a laser beam selectively to one or more localities on the modified brushes.

In a method of making such a brush according to the invention, a twisted-in-wire brush of initially conventional character may be produced and trimmed using entirely conventional brush-making equipment. Equipment of this type, and procedures for using it to produce a conventional twisted-in-wire mascara brush, are well known to persons skilled in the art and accordingly need not be further described. Examples of such procedures are set forth, for instance, in U.S. Pat. Nos. 4,733,425 and 4,861,179, the disclosures of which are incorporated herein by this reference.

Figure 3A:
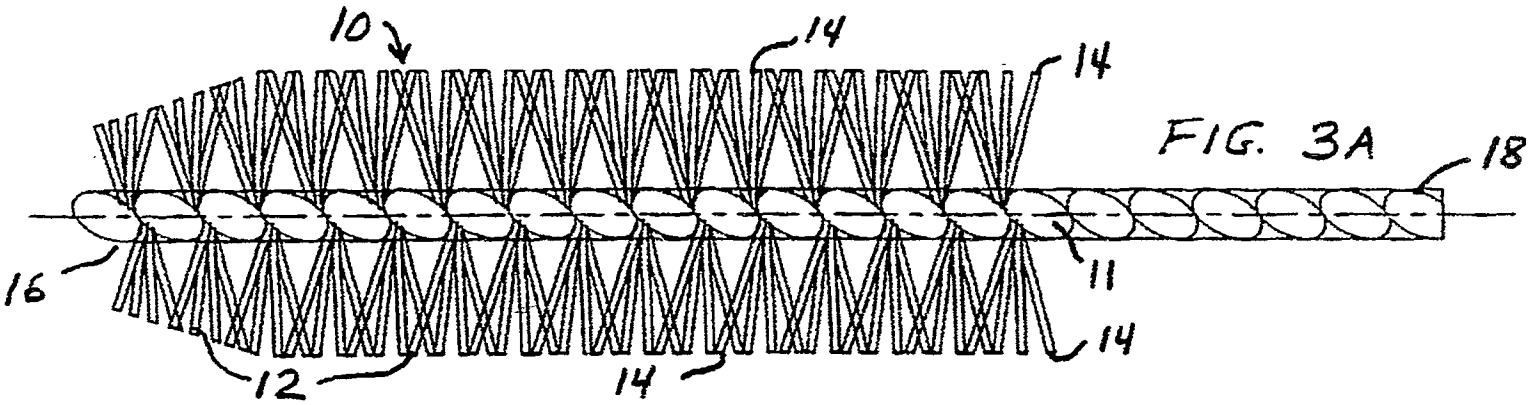
FIGS. 3A and 3B are schematic side views of a mascara brush before and after treatment with a laser beam in the practice of the aforementioned embodiment of the present method using the apparatus of FIG. 1, the brush of FIG. 3B being an exemplary embodiment of the applicator brush of the invention.

As shown in FIG. 3A, the brush 10 at this stage is constituted of an axially rectilinear twisted wire core 11 from which a multiplicity of fibers or bristles 12 extend in a radial array from the core 10. Each bristle has opposed free ends or tips 14 and is gripped between these tips by the wire core; the tips cooperatively define a profile or notional envelope of the bristle brush array. After assembly and twisting of the core, the bristle ends are trimmed (e.g. by mechanical cutting equipment) to shape the brush profile as a cylinder with a distally tapering frusto-conical portion at the distal end 16 of the brush. The proximal end 18 of the core extends for some distance beyond the bristle array to enable the brush to be gripped, and ultimately to be mounted in the stem of a cap (not shown).

In the stage represented by FIG. 3A, the individual bristles extend in essentially straight lines from the core 10, which grips their midpoints, to their respective free tips. The bristles are lengths of a thermoplastic fiber, such a nylon fiber formed by extrusion; in cross-section they may have any of a variety of configurations including, but not limited to, solid round, hollow round, multifinned and multilobed. The bristles of the brush of FIG. 3A are all of the same thickness, cross-section and material, for ease of production, but the invention in its broader aspects is not limited to brushes having uniform bristles throughout.

As a feature of the method of the invention, a brush in the condition shown in FIG. 3A is placed into a holding fixture and presented to a laser which emits a beam of focused energy that is guided to selectively irradiate at least some of the bristles at one or more localities intermediate their free tips and the core and thereby to modify the shapes and/or the surface textures of the individual irradiated bristles.

Figure 3B:
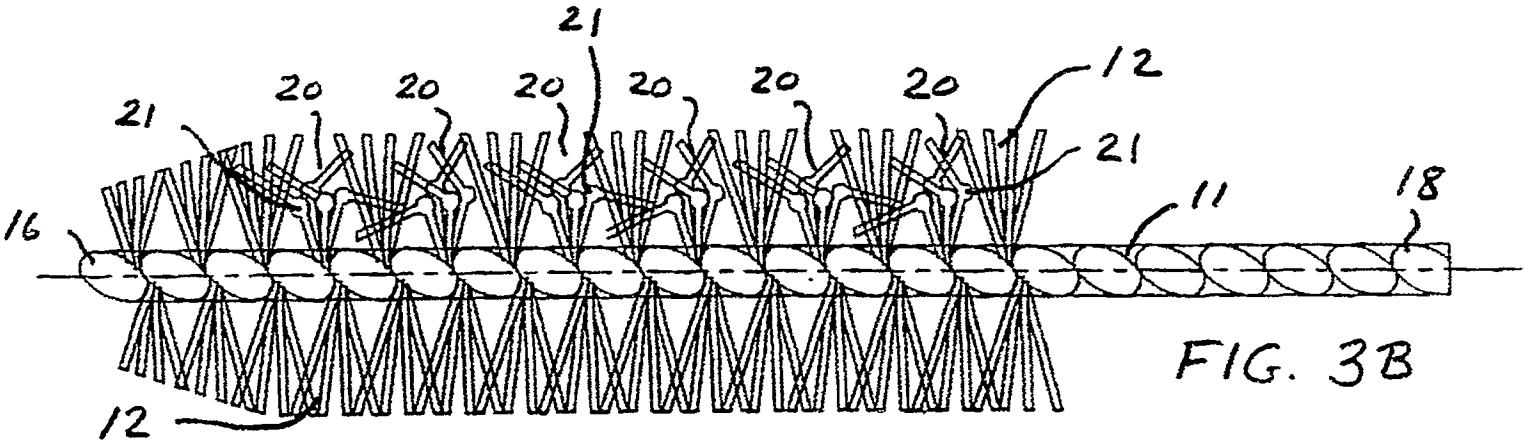

In this way, i.e. by selective irradiation with guided laser energy, the bristles, already assembled to form a brush as shown, can be altered from their original straight configuration to have bends at various distances along their length (i.e. between their free tips and the core) to improve the ability of the brush to carry and deliver the cosmetic product. FIG. 3B shows such a brush, embodying the present invention and produced from the brush of FIG. 3A by selective laser irradiation to bend some of the bristles at localities 20, with local enlargements 21 at the points of bending. Additionally, the tips of the bristles can be expanded or melted back (not shown), to create the effect of beaded tips on the bristles altering the cross-sectional shape of the fiber to improve the separating action of the brush on the lashes.

The surface texture of the fibers can also be made rougher in selected areas of the brush, by the irradiation of those areas with laser energy, to improve the ability of the fibers to hold a mascara formula.

The various effects of the laser treatment to the fibers can be combined, in an individual brush, to customize the brush as desired. Any single type of treatment can be applied to the whole brush, or only to a selected portion of it without affecting the remaining fibers.

During this laser irradiation process, the motion of both the brush and the laser are controlled on multiple axes to allow focusing of the laser energy in selected areas while the energy level and dwell time on the bristles are also being controlled.

The holding fixture for the brush and the laser unit can be mounted on multi-axis computer controlled positioning systems. In currently preferred embodiments, the brush is held in a fixture that is rotated by means of a computer controlled stepper motor that can rotate continuously or through defined patterns of motion during treatment. The laser unit is mounted on a multi-axis computer controlled slide and rotation mechanism that allows for control of the motion of the focused light energy with respect to the brush.

Figure 1:
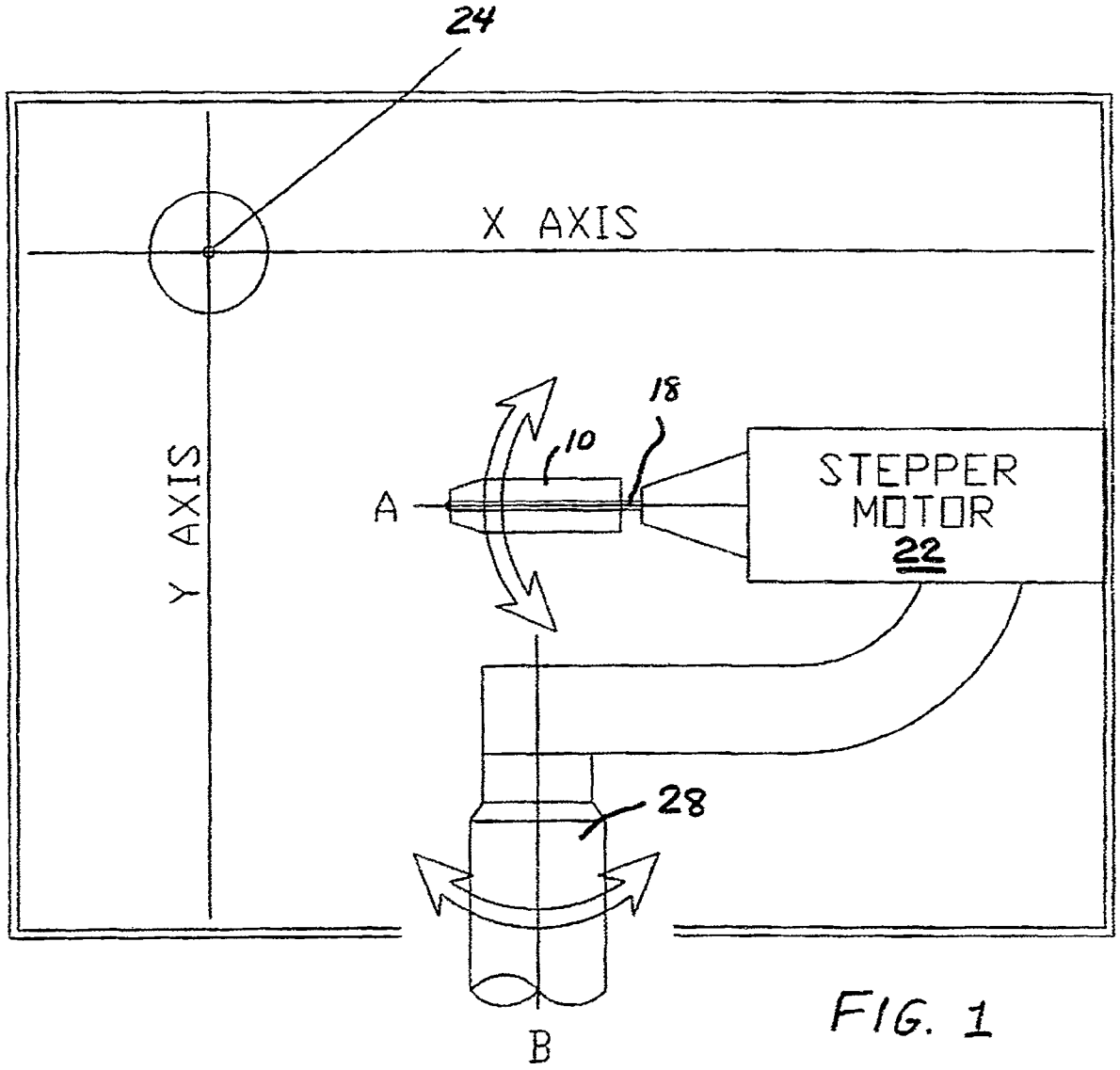
FIG. 1 is a diagram of apparatus for performing the laser-irradiating step of the method of the present invention in an illustrative embodiment.

More particularly, the apparatus shown diagrammatically in FIG. 1 includes a stepper motor 22 in which the proximal end 18 of the core of a twisted-in-wire mascara brush 10 (i.e., the brush illustrated in FIG. 3A as described above) is held for rotation about the axis of the core (axis A) while portions of the brush bristle array are selectively irradiated by a beam from a laser 24. In the showing of FIG. 1, the direction of the beam emitted by laser 24 is perpendicular to the plane of the view.

The laser is movable, under control of a computer, about two axes (represented as an X axis and a Y axis perpendicular thereto) with respect to the rest of the apparatus. Such two-axis computer controlled lasers, including mounts and mechanisms for moving them, are known and are currently employed for such purposes as laser engraving or laser coding. The laser can be turned on and off during the progress of its beam across the brush.

The brush can be rotated through any angle around its central axis A as controlled by a computer (not shown) driving the stepper motor 22. Motion can be started, stopped or pulsed as desired to expose various portions of the brush to continuous or varying amounts of electromagnetic radiation from the laser. In addition, the motor assembly holding the brush is supported on a mount 28 for rotation through a range of 270E around an axis B with respect to the laser, allowing for exposure of the brush to the laser from any angle including parallel to axis A.

Figure 2A:
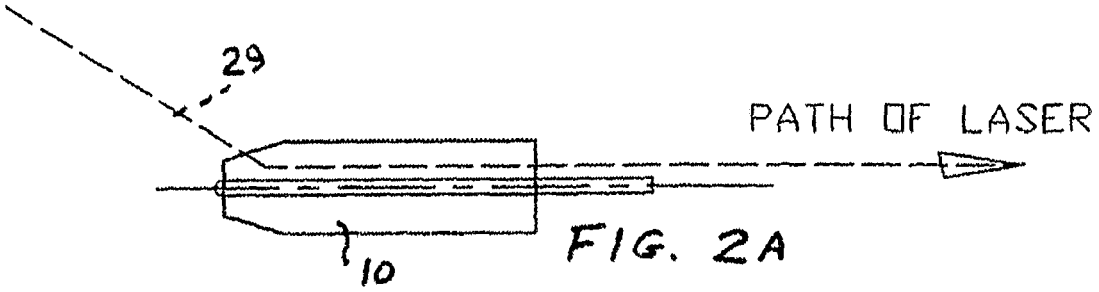
FIGS. 2A, 2B and 2C are diagrams showing examples of the path of a laser beam relative to a brush being irradiated, in performance of the method of the invention with the apparatus of FIG. 1.
Figure 2B:
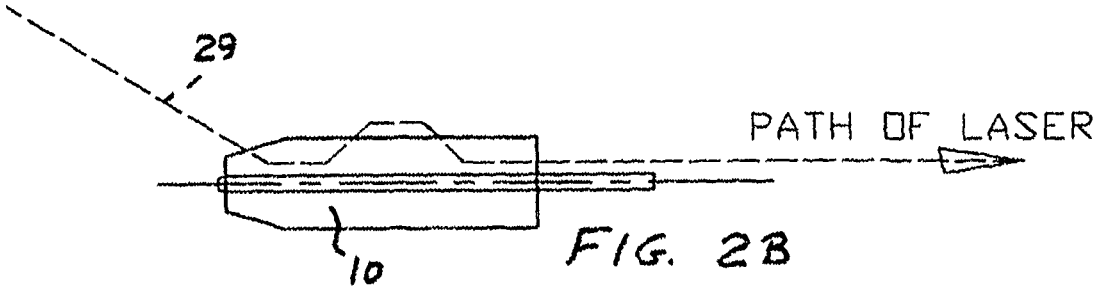
Figure 2C:
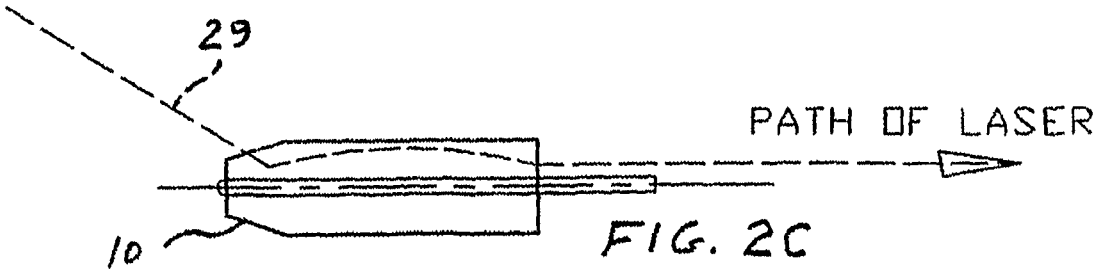

FIGS. 2A, 2B and 2C illustrate various simple examples of the path 29 of the laser 24 with respect to the brush 10. In these examples, the brush is shown as remaining stationary to indicate the variability of path options for the laser in the X-Y axis as driven by paired linear actuators (not shown). Independent motion of the brush as described above provides the flexibility to direct the energy from the laser at a multitude of positions and angles with respect to the brush. The X-Y axis controller in the apparatus is programmable to drive the laser across the brush in any desired path. The brush can remain stationary (as shown) during treatment or be rotated and/or angled to present any portion of its surface to the radiation.

FIG. 3B, viewed in comparison with FIG. 3A, shows the effect of selectively directing energy to the bristles via the laser; i.e., whereas FIG. 3A shows the assembled twisted-in-wire brush prior to the laser treatment, FIG. 3B illustrates the brush after treatment with the laser beam to selectively deform and deflect sections of bristles. Areas 20 of the array of bristles are melted at some point along their length to deflect them at random angles with respect to the untreated bristles. The functional aspect of the treatment is to provide relatively short bristles shaped in a way to hold a pasty cosmetic product like mascara while leaving longer, untreated bristles to provide a combing action. The diagram shows a brush with some groups 20 of bristles of one side deflected by melting the plastic material of the bristles near their midpoints. Using the apparatus described above it will be possible to treat up to 100% of the bristles in any area of the brush.

In a hypothetical example of currently preferred apparatus features and process conditions, the laser used is a $CO_2$ laser capable of power output from 25 to 250 watts. Feed speeds for the laser as it moves across the material range from 1 to 50 meters per minute. Motions of both the laser and the brushes are controlled as described above; the most likely configuration has two-axis motion of the laser while the brush can be rotated and angled with respect to the beam. Air assist (not shown) is employed to remove any loose material freed by the process but the goal is not to cut the fiber, only to modify it at any point along the individual fibers. Fibers are made of thermoplastic material, most commonly polyamide (nylon); the wire of the core is most commonly stainless steel. End uses of the produced brush are for the application of viscous cosmetic products, particularly mascara for eyelashes.

It is to be understood that the invention is not limited to the features and embodiments hereinabove specifically set forth, but may be carried out in other ways without departure from its spirit.

What is claimed is:

1. A cosmetic applicator brush, comprising a core and an array of thermoplastic bristles with free ends radiating outwardly from the core, wherein at least some of the bristles are modified in shape by bending at one or more points of bending between their free tips and the core with local enlargements at the points of bending, and wherein the local enlargements occur only at the points of bending between unbent sections of the bristles.

2. A brush as defined in claim 1, wherein the core is a twisted wire core and the bristles are fibers each having opposed free tips and are gripped in the core intermediate their free tips.

3. A brush as defined in claim 2, for application of mascara, wherein at least some of said bristles are modified in shape by bending at one or more localities between their free tips and the core by selective irradiation of said one or more localities with laser energy, thereby to enhance the ability of the brush to carry and deliver mascara from a container thereof to a user's eyelashes.

4. A brush as defined in claim 2, for application of mascara, wherein at least some of said bristles are modified in surface texture at said one or more points of bending between their free tips and the core, thereby to enhance the ability of the brush to carry and deliver mascara from a container thereof to a user's eyelashes.

5. A method of making a brush for applying cosmetic material or the like, comprising the steps of (a) forming a twisted-in-wire brush including an elongated twisted wire core and a multiplicity of thermoplastic bristles clamped in the core and extending radially therefrom to constitute a brush bristle array projecting outwardly around the core, the bristles having free tips; and (b) irradiating at least some of the bristles of the formed brush with laser energy at one or more selected localities intermediate their free tips and the core to selectively modify the shape of the irradiated bristles by bending them with local enlargements at points of bending, wherein the local enlargements occur only between unbent sections of the bristles.

6. A method according to claim 5, wherein the free tips of the bristles cooperatively define a profile of the brush, and further including the step of shaping the profile by trimming at least some of the bristles of the brush after the forming step and before the irradiating step.

7. A method according to claim 5, wherein the selective modification of the bristles includes modification of at least one of their shape and surface texture at said one or more localities.

8. A method according to claim 7, wherein the irradiating step comprises providing a source of a focused beam of laser energy and subjecting the source and the formed brush to controlled relative motion such that the beam impinges on said one or more localities of said at least some of the bristles to effect said selective modification thereof.

* * * * *